United States Patent [19]

Stickney

[11] 4,424,871

[45] Jan. 10, 1984

[54] TILTING AND ANGLING MECHANISM FOR DOZER BLADE

[75] Inventor: Douglas B. Stickney, Dubuque, Iowa

[73] Assignee: Deere & Company, Moline, Ill.

[21] Appl. No.: 378,675

[22] Filed: May 17, 1982

[51] Int. Cl.[3] ..... E02F 3/76

[52] U.S. Cl. ..... 172/821

[58] Field of Search ..... 172/819, 820, 821, 822, 172/817

[56] References Cited

U.S. PATENT DOCUMENTS

| | | | |
|---|---|---|---|
| 3,991,832 | 11/1976 | Cooper | 172/804 |
| 4,201,268 | 5/1980 | Frisbee | 172/821 |
| 4,248,311 | 2/1981 | Frisbee | 172/819 |
| 4,281,721 | 8/1981 | Beales | 172/821 |

*Primary Examiner*—Richard J. Johnson

[57] ABSTRACT

A dozer blade is attached to a support frame for movement about a universal connection. Angling actuators are connected between the frame and the blade so as to define a tilt axis which passes through the universal connection between the frame and blade.

3 Claims, 3 Drawing Figures

FIG. 2
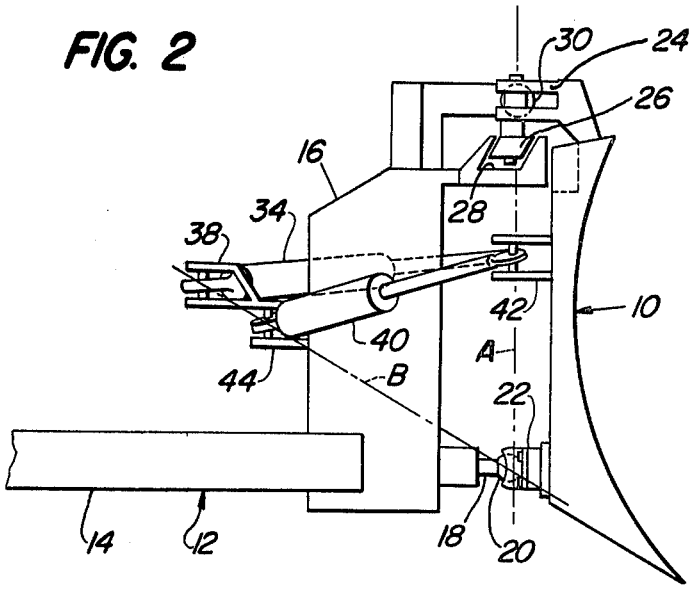
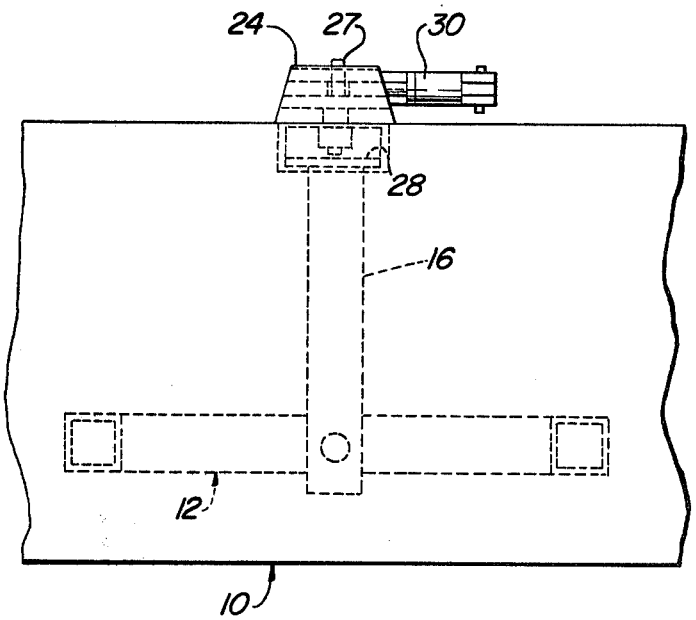
FIG. 3

TILTING AND ANGLING MECHANISM FOR DOZER BLADE

BACKGROUND OF THE INVENTION

The present invention relates to tilting and angling mechanisms for dozer blades and more specifically relates to an improvement in the mechanism disclosed in U.S. Pat. No. 3,991,832 granted to Cooper on Nov. 16, 1976.

The blade tilting and angling mechanism of the Cooper patent relies on special valving located in the hydraulic control system for the tilt and angling actuators for ensuring that excessive pressures are not built up in the angling actuators when the blade is tilted.

SUMMARY OF THE INVENTION

According to the present invention, there is provided an improved tilting and angling mechanism for a dozer blade.

An object of the invention is to provide an angling and tilting mechanism which avoids excessive pressure build-up in the angling actuators during tilting operation without the use of special valving in the hydraulic circuitry.

A more specific object of the invention is to mount the angling actuators in such a way that loads tending to change the length thereof are not induced therein by operation of the tilting actuators.

These and other objects will become apparent from a reading of the ensuing description together with the appended drawing.

BRIEF DESCRIPTION OF THE DRAWING

FIG. 2 is a right side view of the structure shown in FIG. 1.

FIG. 3 is a front elevational view of the central portion of the dozer blade.

DESCRIPTION OF THE PREFERRED EMBODIMENT

Figure 1:
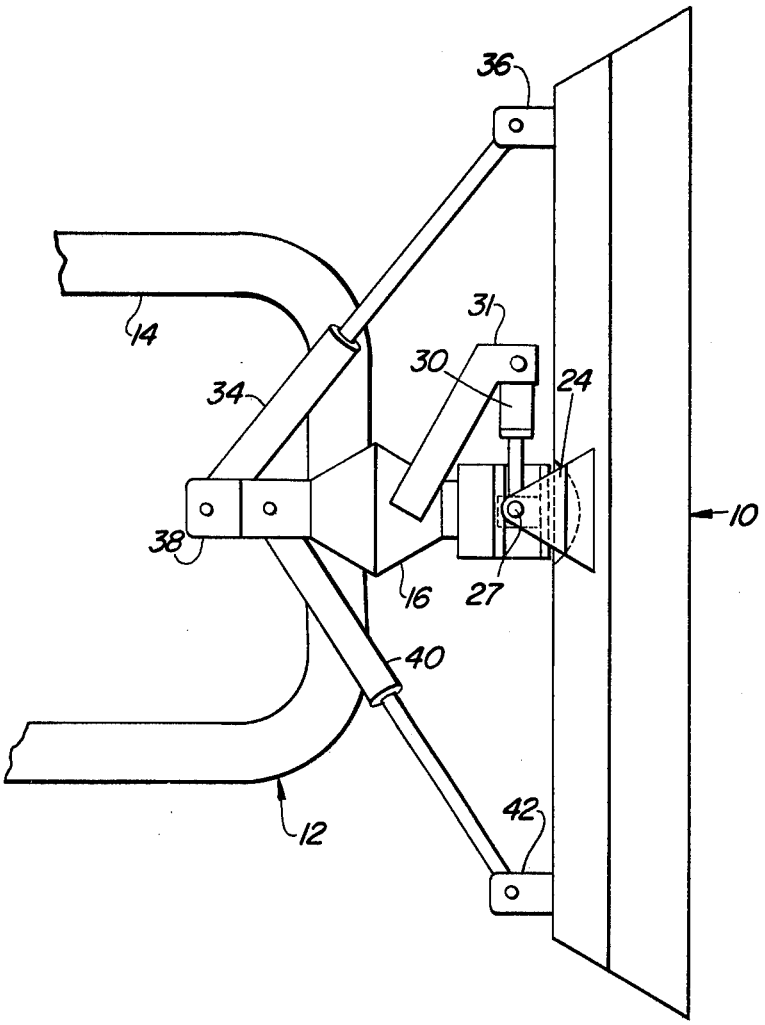
FIG. 1 is a top plan view of a dozer blade mounted on a blade support frame in accordance with the principles of the present invention.

Referring now to the drawing, therein is shown a dozer blade 10 coupled to a blade support frame 12 for tilting and angling movement relative to the frame.

Specifically, the frame 12 includes a rearwardly opening U-shaped structure 14 and an upright post structure 16 secured to the central forward end portion of the structure 14. Located at a lower central location of the post structure 16 is a forwardly projecting rod 18 having a ball 20 secured to the forward end thereof. The ball 20 is received in a socket-forming member 22 fixed to a lower, central rear location of the blade and cooperates with the socket-forming member to establish a universal connection between the frame and blade. Fixed to and projecting rearwardly from a central location of the blade 10 is a triangular bracket 24 having a slide block 26 pivotally mounted thereon by a pivot pin 27 located along an axis A which passes through the center of the ball 20 and serves as the angle axis of the blade. The post structure 16 includes a forwardly projecting portion at its upper end which defines an upwardly opening guide track 28. The slide block 26 is received in the track 28.

A plurality of extensible and retractable hydraulic actuators are connected between the blade 10 and the post structure 16 for adjusting the blade about its unversal connection with the frame. Specifically, a tilt actuator 30 has its cylinder end connected to a bracket 31 projecting leftwardly from the post structure 16 and has a rod end fixed to the slide block 26. A first angling actuator 34 is connected between a bracket 36 fixed to the blade 10 adjacent the left end thereof and a bracket 38 projecting rearwardly from the post structure 16. A second angling actuator 40 is connected between a bracket 42 fixed to the blade 10 adjacent the right end thereof and a bracket 44 projecting rearwardly from the post structure 16 at a location below the bracket 38. The connections of the actuators 30, 34 and 40 with the brackets 31, 38 and 44 are universal, and the bracket 44 is positioned forwardly of the bracket 38 so that the universal connections and the ball 20 fall on a common axis B, the axis B being the tilt axis of the blade 10.

Thus, extension of the tilt actuator 30 from its illustrated centered position will result in the left- and right-hand ends of the blade 10, respectively, being lowered and raised about the axis B with the angling actuators 34 and 40 moving together with the blade. Tilting of the blade 10 in the reverse direction is accomplished by retracting the actuator 30.

I claim:

1. In a combination including a dozer blade and support frame therefor connected together by a main universal connection, a stabilizer connection between the frame and blade for guiding the movement of the blade relative to the frame, the main universal connection and stabilizer connections cooperating to define and angle axis which shifts relative to frame about which the blade is anglable relative to the frame, a pair of extensible and retractable, hydraulic angling actuators connected between the frame and locations of the blade at opposite sides of the main universal connection for angling the blade about the angle axis, and an extensible and retractable, hydraulic tilt actuator for effecting tilting movements of the blade, the improvement comprising: the pair of angling actuators respectively having first and second universal connections with the frame which are located on an axis passing through the main universal connection to thereby establish a tilt axis, whereby extension or retraction of the tilt actuator will effect tilting movement of the blade about said tilt axis without inducing loads on the angling actuators.

2. The combination defined in claim 1 wherein the frame includes an upright post structure and said first and second universal connections being located at different heights on said post structure.

3. The combination defined in claim 2 wherein the post structure is joined to a central forward position of a rearwardly opening U-shaped portion of the frame; and said universal connections being positioned at respective rear locations along the post structure.

* * * * *